US008695300B2

(12) United States Patent
Hartl

(10) Patent No.: US 8,695,300 B2
(45) Date of Patent: Apr. 15, 2014

(54) SUPPORT PLATE AND METHOD FOR PRODUCING SUCH A SUPPORT PLATE

(75) Inventor: Martin Hartl, Horb a. Neckar (DE)

(73) Assignee: Infinex Holding GmbH, Haiterbach (DE)

( * ) Notice: Subject to any disclaimer, the term of this patent is extended or adjusted under 35 U.S.C. 154(b) by 0 days.

(21) Appl. No.: 13/070,875

(22) Filed: Mar. 24, 2011

(65) Prior Publication Data

US 2011/0232217 A1 Sep. 29, 2011

(30) Foreign Application Priority Data

Mar. 29, 2010 (DE) ..... 10 2010 013 305

(51) Int. Cl.
*E04F 15/02* (2006.01)

(52) U.S. Cl.
USPC ..... 52/390; 52/302.1; 52/385; 52/411

(58) Field of Classification Search
USPC ..... 52/302.1, 302.3, 384–390, 408, 409, 52/411, 169.5
See application file for complete search history.

(56) References Cited

U.S. PATENT DOCUMENTS 1,867,897 A * 7/1932 Stanbrough ..... 52/388
5,052,161 A * 10/1991 Whitacre ..... 52/385
5,255,482 A * 10/1993 Whitacre ..... 52/390
5,390,467 A * 2/1995 Shuert ..... 52/783.14
5,927,033 A * 7/1999 Kreckl ..... 52/390
6,131,005 A * 10/2000 Ozawa ..... 399/107
6,151,854 A * 11/2000 Gutjahr ..... 52/385
6,434,901 B1 * 8/2002 Schluter ..... 52/302.1
7,536,835 B2 * 5/2009 Schluter ..... 52/390
7,614,193 B2 * 11/2009 Turner et al. ..... 52/385
2001/0018816 A1 * 9/2001 Hoepker et al. ..... 52/783.17
2002/0002937 A1 * 1/2002 Modesitt et al. ..... 108/57.34
2004/0040257 A1 * 3/2004 Bui ..... 52/782.1
2006/0201092 A1 * 9/2006 Saathoff et al. ..... 52/385

* cited by examiner

*Primary Examiner* — Brian Glessner
*Assistant Examiner* — Beth Stephan
(74) *Attorney, Agent, or Firm* — Renner, Otto, Boisselle & Sklar, LLP

(57) ABSTRACT

A support plate for a slab-lined wall, ceiling, or floor construction for achieving decoupling between a ground and a surface lining to be affixed to the support plate. The support plate comprises a foil-like plate made of plastic material and provided with a plurality of chambers constituted by recesses with respect to a plane of the foil-like plate, outer end faces which form a first plate side and on an opposite side a second plate side, the recesses being configured for receiving a hardening contact means for providing a contact layer for the surface lining to be applied, a woven or non-woven fabric disposed on the first plate side, and an adhesion-strengthening layer made of a web-like material being applied to at least one of the first or second plate sides for lining at least the recesses of the chambers.

14 Claims, 1 Drawing Sheet

SUPPORT PLATE AND METHOD FOR PRODUCING SUCH A SUPPORT PLATE

RELATED APPLICATIONS

This application claims priority to German Application No. 10 2010 013 305.1 filed on Mar. 29, 2010, which is hereby incorporated by reference.

FIELD OF INVENTION

The invention relates to a method of producing a support plate and to a support plate for a slab-lined floor, wall, or ceiling construction for achieving decoupling between the ground and the surface lining to be applied to the foil-like plate.

BACKGROUND

In many cases, slab coverings are laid using what is called a thin-bed method, with an appropriate contact adhesive being utilised in order to affix the slab coverings to the ground. Owing to varying degrees of thermal expansion between the surface lining and the ground and to the tensions associated with this, cracks may occur in the surface lining, which may ultimately lead to a detaching of parts of the surface lining.

In order to reduce such tension differences, DE 37 0441 4 A1 proposes a support plate made of a foil-like plastic material and comprising dovetailed grooves that are alternately open towards both sides, such that under conditions of compressive stress and tensile load said plate is movable in a cross-direction with respect to the extension of the grooves. On one side of the support plate, a net-like, non-woven fabric is provided in order to connect the support plate with the ground, for example a screed, and to achieve an enhanced bonding effect with an adhesive. This support plate has the disadvantage of being limited to one direction of expansibility and/or compressibility, which is a cross-direction with respect to the longitudinal extension of the dovetailed grooves. A support plate of this type is often not capable of ensuring the necessary tension reduction.

In order to achieve said tension reduction in both directions, a support plate has been proposed, according to DE 299 24 180 U1, which comprises embossings intersecting one another on one plate side so as to form, and circumferentially delimit, closed chambers. The chambers serve the purposes of receiving an adhesive or mortar and of forming adhesive or mortar stilts, which enables the formation of a tight bond with the adhesive or mortar layer and the surface lining affixed thereto. With said intersecting embossings, a foil-like plate is proposed which may be expanded or compressed, at least to a small extent, in both directions of the plane in which it extends, so that differences in tension between the ground and the surface lining may be absorbed by the support plate. In addition, the chambers have undercuts so that the adhesive or mortar stilts introduced into the chambers become caught in the undercuts of the chambers.

This configuration has the disadvantage that in the region of the undercut, the mortar stilts have a narrowing as compared to their post surface within the bottom of the chamber and that in the region of the narrowing, crack formation is an issue and the upstanding post members inserted into the chambers may become detached from the mortar layer resting on top of them. The positive interlocking initially provided by the undercut is severed by the formation of cracks occurring on the level of the narrowing. The tight bond no longer exists and the tension reduction between the ground and the surface lining is no longer possible.

DE 20 2005 004 127 U1 discloses a support plate made of a foil-like plastic material to be used in slob-faced floor, wall, or ceiling constructions which comprises a support plate consisting of a foil-like plate having recesses without undercuts. These recesses either have wall portions extending vertically between the one plate side and the outer end faces or have conically tapered wall portions. On the plate side from where the recesses extend, a net-like, woven or non-woven fabric covering or overlapping said recesses is provided, which is to say that the woven or non-woven fabric is realised in the form of a layer extending in a plane and spanning said recess. Owing to said net-like nature of the fabric, this configuration makes it possible for the adhesive or mortar layer that is to be applied thereto to permeate through the non-woven fabric overlapping the recesses and pass into said recesses and become bonded. Introducing the adhesive or mortar layer into the recesses will thus lead to the formation of adhesive or mortar stilts which become bonded with the woven or non-woven fabric, said non-woven fabric fully traversing the mortar stilt. This support plate makes it possible to satisfactorily reduce tensions occurring between the ground and the surface lining and to ensure a continuous decoupling as well as a secure fixation of the surface lining. However, the requirements that have to be met by such support plates are ever increasing.

SUMMARY OF INVENTION

The invention provides a support plate made of a foil-like plastic material to be used in slab-faced floor, wall, or ceiling constructions which can be fabricated, and laid, in a simple manner, and that enables an enhanced decoupling, and/or reduction of tension differences, between the ground and the surface lining, as well as a method permitting the production thereof in a simple manner.

In particular, the invention provides a method of producing a support plate to be used in floor, wall, or ceiling constructions wherein a foil-like plate made of a foil-like plastic material and having recesses formed therein is fed to a first processing station in which an adhesion-strengthening layer made of a web-like material is applied to at least one plate side, in particular the side from where the recesses extend, and in which at least said recesses are lined by said adhesion-strengthening layer made of the web-like material. The lining of the recesses implies that the adhesion-strengthening layer closely fits the wall portions, in other words the side walls and the bottom, of the respective recess. This fabrication method makes it possible to achieve high processing rates and in particular, by employing what is called an inline method using a preferably continuous feed rate of both, webs and layers, to apply on an upper surface and/or a lower surface, or on a first and/or second plate side of the foil-like plate, an adhesion-strengthening layer made of a web-like material. The adhesion-strengthening layer made of a web-like material serves for enhancing the surface roughness of at least the recesses and/or increases the clinging action of the mortar or adhesive layer which is introduced into the recesses and applied to the surface portions surrounding the recesses. Owing to the configuration of the adhesion-strengthening layer, which is made of a web-like material, it is possible, in particular, to employ the inline method.

In another method according to the invention for producing a support plate to be used in a floor, wall, or ceiling construction, provision is made for a foil-like plate made of plastic material which is first flat or free from recesses, and an adhesion-strengthening layer made of a web-like material are fed to a processing station, such that one single forming step is employed to form the recesses in the foil-like plate and to apply the layer of web-like material to at least one plate side, in particular to the side from where said recesses extend, and to line at least the recesses. This method has the advantage that both the formation of the recess and at least the lining of the recess by the adhesion-strengthening layer made of a web-like material are carried out simultaneously.

In a preferred embodiment of the method, provision is made for the adhesion-strengthening layer to be applied, in the processing station, at least to the recesses of the foil-like plate, or for a woven or non-woven fabric to be applied, in a subsequent processing station, to the outer end face of the first plate side. Depending on the technique employed, it is possible, according to a first embodiment, to utilise a common processing station in order to apply both the adhesion-strengthening layer on the one plate side and the woven or non-woven fabric on the other plate side. According to an alternative embodiment, the woven or non-woven fabric may be applied to the yet unmethoded plate side in a separate processing station. In both alternatives, the woven and non-woven fabrics are preferably affixed only to the end faces of the first plate side. The empty spaces left between the end faces are spanned by the woven or non-woven fabric in a self-supporting manner.

In a preferred configuration of the methodes, provision is made for the foil-like plate and/or the adhesion-strengthening layer made of a web-like material and/or the woven or non-woven fabric to be heated on one side or on both sides before being fed to the processing stations. Thus it is possible for the individual components to be connected to one another in a simple manner by a single processing operation, in particular a welding operation.

In a further preferred embodiment, provision is made for at least the adhesion-strengthening layer made of a web-like material to be laminated, or welded, onto the foil-like plate. The welding of the adhesion-strengthening layer onto the foil-like plate may in particular eliminate the necessity of applying an adhesive layer and thus of performing an additional processing step. By the welding or laminating operation, a firm and durable bond between the adhesion-strengthening layer and the foil-like plate may be achieved. The same is true, by analogy, of the woven or non-woven fabric applied on the opposite plate side of the foil-like plate.

The invention further provides a support plate according to the present invention to be used in a floor, wall, or ceiling construction which has a foil-like plate made of plastic material and provided with a plurality of chambers constituted by recesses with respect to a plane of the foil-like plate, the outer end faces of which form a first plate side, and which, on the opposite side, has a second plate side, with an adhesion-strengthening layer made of a web-like material being applied to at least one plate side, said layer lining at least the recesses of the chambers. A support plate of this type has the advantage of enabling a simple introduction of the adhesive or mortar into the recesses for the purpose of fixating the surface lining and, at the same time, improving the bonding action between the adhesive or mortar and the support plate due to the adhesion-enhancing or adhesion-strengthening layer made of a web-like material. This prevents the surface lining from becoming loosened or detached. In addition, a uniform introduction of force into the foil-like plate may thus take place via the mortar stilts. Lining the chamber recesses, the adhesion-strengthening layer closely fits the side wall and the bottom of the respective recess, so that there is no such thing as a flat region of the layer consisting of non-woven or woven fabric according to the present invention covering the recess or overlapping the recess in a self-supporting manner, through which the mortar or adhesive might pass when introduced into the recess.

In a preferred configuration of the support plate, provision is made for the foil-like plate to have the adhesion-strengthening layer on the second plate side and a woven or non-woven fabric disposed on the first plate side. Support plates of this type are used in particular for interior works in which the support plate is bonded together with the ground, in most cases a screed, on which it is laid.

In a preferred embodiment of the support plate, provision is made for the wall portions present between the end faces of the cambers forming the one plate side and the surface portions connecting the chambers which form the opposite plate side to extend either vertically or in a conically tapered manner towards the respective chamber end faces. This configuration facilitates full introduction of the mortar or adhesive into the chambers so as to fill said chambers entirely with mortar or adhesive.

In a further preferred configuration of the invention, provision is made for the foil-like plate to be formed of a thermoplastic elastomer, in particular high-density polyethylene (HDPE), PE (polyethylene) or PP (polypropylene). These are cost-effective plastic materials which are particularly appropriate for this field of application.

In a further preferred configuration of the support plate, provision is made for the adhesion-enhancing layer formed of a web-like material to be at least partially bonded, laminated, or welded onto the inside of said recesses and on the surface portions of the plate side. This adhesion-enhancing layer made of a web-like material makes it possible, on the one hand, for the applied mortar or adhesive layer to have an increased mechanical bond with the foil-like plate and, on the other hand, makes the choice of a material to be used for the foil-like plate independent of the adhesion characteristics thereof with respect to the mortar or adhesive layer, while ensuring nonetheless a secure connection between the foil-like plate and the mortar or adhesive layer.

According to a preferred configuration of the support plate, provision is made for the adhesion-enhancing layer made of a web-like material to be realised as a mesh-like or net-like, woven fabric or as a web of perforated material which may be formed, for example, from synthetic fibres and/or textile fibres.

In an alternative configuration of the adhesion-enhancing layer made of a web-like material, provision is made for a non-woven fabric to be utilised. This may be a non-woven filter or a non-woven fabric made of synthetic fibres and/or natural fibres which, in particular, is provided with a grid or mesh structure or a hole structure or an increased surface structure.

Furthermore, provision may alternatively be made for the adhesion-enhancing layer to be formed from a plastic foil having components such as glass fibres or binders for the adhesive or mortar layer incorporated therein and/or granules applied to the outer surface and/or introduced into the layer or the like in order to achieve an interlocking effect or an adhesion-enhancing effect or a strong mechanical bond with the adhesive or mortar layer.

According to a further advantageous configuration of the support plate, provision is made for the same adhesion-enhancing layer made of a web-like material to be applied to both the first and second plate sides of the foil-like plate. Thus the support plate may be fabricated in a very cost-effective manner. In addition, due to the selection of an identical adhesion-enhancing layer for both sides, the adhesion characteristics with respect to the foil-like plate are identical, resulting in a simplified fabrication of a support plate of this type.

BRIEF DESCRIPTION OF THE DRAWINGS

The invention, as well as other advantageous embodiments and developments thereof, will be described and explained in the following with reference being made to the examples shown in the drawings. The characteristics issuing from the description and the drawings may be applied according to the present invention either individually or as a plurality of features taken in any combination. In the drawings.

DETAILED DESCRIPTION

Figure 1:
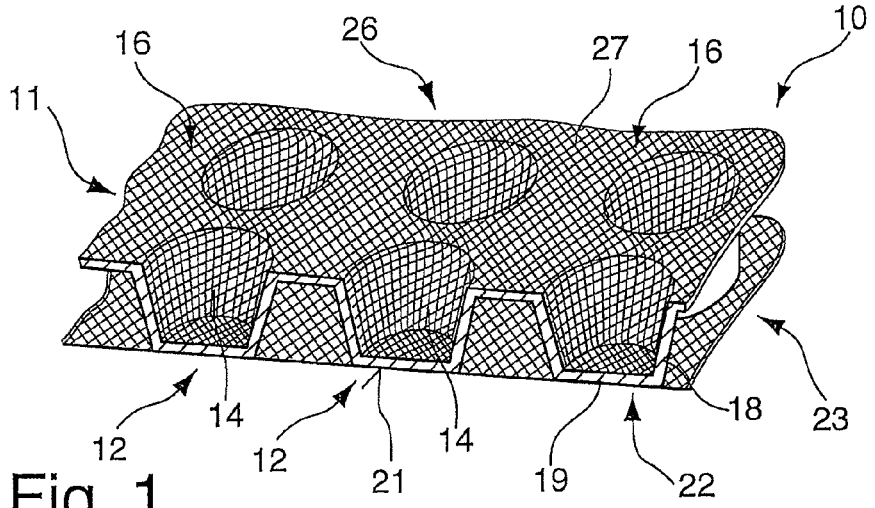
FIG. 1 is a perspective view of the support plate according to the present invention.

A support plate 10 according to the present invention is represented in FIG. 1. This support plate 10 comprises a foil-like plate 11 made of plastic material and having a plurality of chambers 12 constituted by means of recesses 14 formed in the foil-like plate 11. The recesses 14 of the chambers 12, preferably aligned on one side and identically oriented, are preferably realised in a repetitive arrangement of rows and columns or in some other defined pattern with respect to one another. Surface portions 16 are formed between the recesses 14 so as to connect the chambers 12 with each other. According to a first embodiment, conically tapered wall portions 18 extend from these surface portions 16 and merge each with a bottom 19, the respective outer end faces 21 of which form a first plate side 22. A woven or non-woven fabric 23 is laminated, or welded, on the end faces 21 of the chambers 12 and serves for ensuring a tight mechanical bonding between the support plate 10 and a contact layer consisting of adhesive or mortar applied to a ground. The woven or nonwoven fabric 23 is preferably realised in the form of a net-like fabric, in particular a fine-mesh woven grid or a perforated non-woven fabric. A fabric of this type may, for example, be formed from polypropylene.

Opposite the first plate side 22, a second plate side 26 is provided which is formed by the surface portions 16 interconnecting the chambers 12, and by the recesses 14. On said plate side 26, an adhesion-strengthening layer 27 made of a web-like material may be applied so as to line at least an inner surface of the recesses 14 and is connected to said inner surface. Preferably, this adhesion-strengthening layer 27 is also connected to the surface portions 16. Preferably, the adhesion-strengthening layer 27 is applied all-over to the second plate side 26. Preferably, the adhesion-strengthening layer 27 is welded or laminated onto the foil-like plate. In some cases, provision may be made for said layer to be applied by pressing or bonding. Thus, the adhesion-strengthening layer 27 comprises the same contour as the second plate side 26. According to a first preferred embodiment, the adhesion-strengthening layer 27 is formed by a fine-mesh, woven fabric, in particular a woven grid, or by a perforated, non-woven fabric. Preferably, the adhesion-strengthening layer 27 is a perforated, non-woven fabric or a non-woven filter which is, for example, made of polyethylene or polypropylene. Likewise, a perforated plastic foil or a plastic foil having adhesion-strengthening components may be provided. These may be in the form of glass fibres or granules which protrude at least partially from the surface of the adhesion-strengthening layer.

According to a preferred embodiment of the support plate 10, the woven or non-woven fabric 23 is of the same material, and is applied by the same procedure, for example by welding, as the adhesion-strengthening layer 27.

Alternatively, provision may be made for the adhesion-strengthening layer 27 to be welded or laminated onto both sides of the foil-like plate 11. The second adhesion-strengthening layer 27 is applied in a manner analogous to the first adhesion-strengthening layer 27 and may be applied simultaneously with, or subsequently to, the first adhesion-strengthening layer 27.

The chambers 12 of the foil-like plate 11 represented in FIG. 1 have a circular bottom 19 and are thus realised in a frusto-conical shape. As an alternative to the round bottom surfaces, provision may be made for the bottom surfaces to be triangular, square, or polygonal, or else rhombus-shaped or trapezoidal bottom surfaces or profiled bottom surfaces may be provided.

Figure 2:
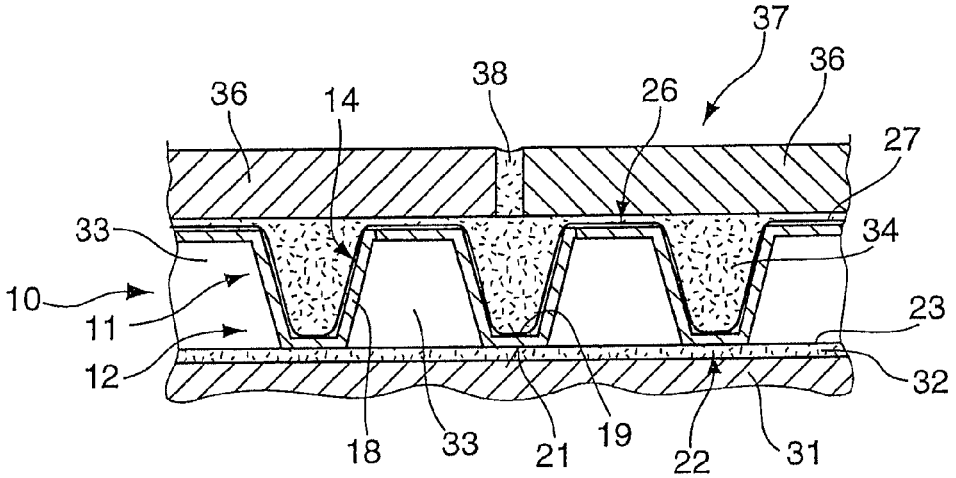
FIG. 2 is a schematic sectional view of the support plate of the invention according to FIG. 1 as seen in an installation situation, designed for decoupling variations in tension.

FIG. 2 represents a schematic side view of the support plate 10 according to the present invention, shown in an installation situation. Adhesive or mortar 32 is applied to a ground 31. Subsequently, the foil-like plate 11 lined with the woven or non-woven fabric 23 is placed on the ground 31. The mortar 32 forms a mechanical bond with the woven or non-woven fabric 23. The mesh size of the woven fabric or perforation size of the non-woven fabric 23 is such that although upon laying of the support plate 10, the mortar will not enter the regions 33, i.e. the empty spaces formed between the chambers 12, a strong mechanical bond is formed with the woven or non-woven fabric 23. Air circulation in these empty spaces may thus take place.

Subsequently, adhesive or mortar 34 is applied to the second plate side 26. The mortar or adhesive 34 may differ from the adhesive 32 applied to the ground. The mortar or adhesive 34 is applied to the surface portions 16 and the chambers 12 are filled up, so that preferably a flat and continuous support surface is formed by the mortar or adhesive 32 for a surface lining 37 consisting of individual tiles or slabs 36 to be received and fixed thereon. As the chambers 12 are filled and the mortar or adhesive 34 is spread on the surface portions 16, the adhesion-strengthening layer 27 causes the adhesive or mortar 34 to become caught at the surface of said layer 27. At the same time, mortar stilts, as they are called, may be formed in the recesses 14, permitting load transfer to the ground 31 to take place. Once the plates 36 forming the surface lining 37 have been applied and the adhesive or mortar 34 has hardened, a joint material 38 is inserted in order to terminate the surface lining 37.

Figure 3:
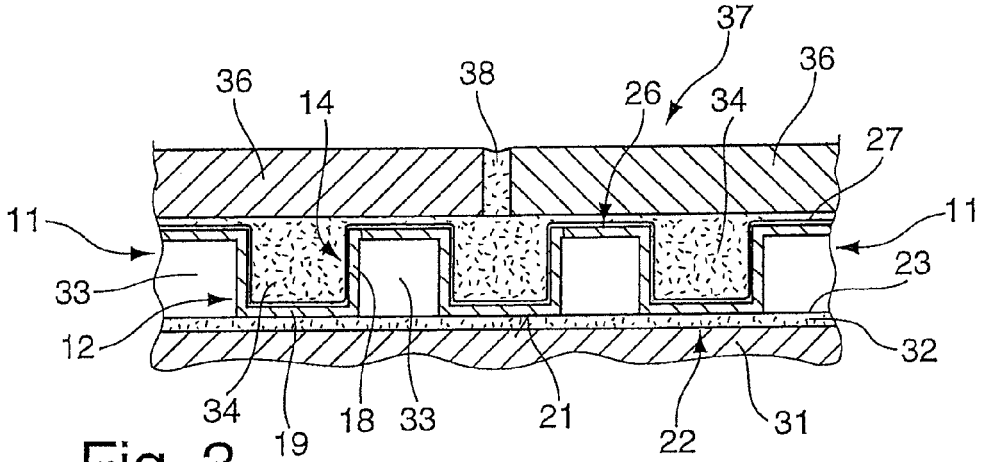
FIG. 3 is a schematic sectional view of an alternative configuration of the support plate according to FIG. 1.

FIG. 3 represents an alternative embodiment of the support plate 10 according to the present invention, shown in an installation situation. The foil-like plate 11 differs from the embodiment in FIG. 1 in that the chambers 12 have a vertical wall portion 18, so that cylindrical recesses 14 are formed. Apart from that, this embodiment is identical to the embodiment according to FIGS. 1 and 2 and offers the same advantages.

For example, the support plate 10 represented in FIG. 1 is fabricated in such a way that first the foil-like plate 11 is provided with chambers 12 by means of vacuum moulding or deep drawing. Subsequently, this foil-like plate 11 provided with chambers 12 is fed to a processing station. In parallel, a length of material of the adhesion-strengthening layer 27 is unrolled from, for example, a feed roller and is equally fed to said processing station. In the processing station, the foil-like plate 11 and the adhesion-strengthening layer 27 constituted by a web-like material are joined together, the adhesion-strengthening layer 27 being applied, in particular, to the second plate side 26, i.e. welded to the surface portions 16 and to the inner surfaces of the recesses 14. This may be provided by using a cylinder having punch-shaped, elevated portions which, on the one hand, move the adhesion-strengthening layer 27 into the recesses 14 and, on the other hand, press it onto the surface portions 16, thus forming a connection which preferably extends all-over between the adhesion-strengthening layer 27 and the second plate side 26. Preferably, the layer 27 is laminated to the surface of the plate side 26 under the action of heat and pressure. On the underside, a corresponding counter cylinder is provided which generates a counter-pressure at least on the outer end faces 21 of the recesses 14. In this processing station or in a subsequent processing station, a woven or non-woven fabric 23 may be fed, and laminated, to the first plate side 22 of the foil-like plate 11, which is bonded, or welded, to the end faces 22 of the recesses 14. Subsequently, the finished support plate 10 is removed, cut to length, and rolled onto rollers or prepared in the form of sheet material, ready for being transported to the place of use. Such fabrication of the support plate may preferably be realised in a continuous fabrication method. Likewise, individual surface portions of the foil-like plate 11 may be connected cyclewise with surface portions of the adhesion-strengthening layer 27 made of a web-like material and with surface portions of a woven or non-woven fabric 23.

In an alternative embodiment of the manufacturing method, provision may be made for a planar, prefabricated, foil-like plate 11 to be fed to a processing station in which both the chambers 12 and their recesses 14 are formed in the plate 11 and the adhesion-strengthening layer 27 is applied to the plate side 26. In the same manner, the other woven or non-woven fabric 23 may be applied, at the same time or at a later stage, to the opposite plate side 22, in other words the first plate side 22.

In a preferred configuration of the support plate 10, provision is made for the same adhesion-strengthening layer 27, or the same material, to be applied to both the first and the second plate sides 22, 26. On the plate side turned towards the surface lining 37, i.e. on the second plate side 26 of the foil-like plate 11, the adhesion-strengthening layer 27 is applied in a contoured manner, which is to say that the adhesion-strengthening layer 27 corresponds to the contour of the second plate side 26, whereas on the first plate side 22, the adhesion-strengthening layer 27 is attached exclusively to the outer end faces 22 of the recesses 14 and is disposed in a stretched, or at least partly stretched, manner over the regions extending therebetween, such that said regions 33 will remain as empty spaces.

The invention claimed is:

1. A support plate for a floor, wall or ceiling construction for achieving decoupling between a ground and a surface lining to be affixed to the support plate, the support plate comprising:

a foil plate made of plastic foil material and provided with a plurality of chambers constituted by recesses disposed with respect to a plane of the foil plate;

wherein the foil plate further includes surface portions interdisposed between the recesses;

wherein the recesses include end portions and wall portions, the wall portions disposed between the end portions and surface portions;

wherein the wall portions extend vertically or conically between the end portions and the surface portions;

wherein first sides of the end portions form a first plate side of the foil plate, and the surface portions and inner surfaces of the recesses on an opposite side of the foil plate form a second plate side; and wherein the inner surfaces of the recesses include surfaces of the wall portions defining the recesses and also include second sides of the end portions opposite the first sides;

a woven or non-woven fabric disposed on the end portions of the recesses on the first plate side; and an adhesion-strengthening layer bonded, laminated, or welded onto inner surfaces of the recesses, and the recesses are provided for receiving a hardening contact means for forming a contact layer for receiving the surface lining;

wherein the adhesion-strengthening layer includes at least one of a net woven fabric, a net non-woven fabric, a mesh woven fabric, a mesh non-woven fabric, a perforated woven fabric, a perforated non-woven fabric, or a synthetic foil.

2. The support plate as claimed in claim 1, wherein the foil plate is provided with the adhesion-strengthening layer disposed on the second plate side.

3. The support plate as claimed in claim 1, wherein the foil plate is formed of a thermoplastic elastomer.

4. The support plate as claimed in claim 1, wherein a second adhesion-strengthening layer is disposed on the first plate side and includes the woven or non-woven fabric, and wherein the adhesion-strengthening layer and the second adhesion-strengthening layer are made of the same material.

5. The support plate as claimed in claim 1, wherein the recesses are substantially frusto-conical.

6. The support plate as claimed in claim 1, wherein the wall portions are substantially conical and the end portions are substantially circular.

7. The support plate as claimed in claim 1, wherein the end portions include top surfaces on the second plate side and bottom surfaces on the first plate side opposite the top surface, wherein the recesses include inner wall surfaces on the second plate side and outer wall surfaces on the first plate side opposite the inner wall surfaces, and wherein the inner surfaces of the recesses include the inner wall surfaces of the wall portions and the top surfaces of the end portions.

8. The support plate as claimed in claim 1, wherein the surface portions include top surfaces on the second plate side and bottom surfaces on the first plate side opposite the top surfaces, wherein the recesses include inner wall surfaces on the second plate side and outer wall surfaces on the first plate side opposite the inner wall surfaces, and wherein the chambers are defined by the outer wall surfaces of the wall portions and the bottom surfaces of the surface portions.

9. The support plate as claimed in claim 3, wherein the thermoplastic elastomer includes at least one of HDPE, PE, or PP.

10. The support plate as claimed in claim 1, wherein the adhesion-strengthening layer includes glass fibres, synthetic fibres, textile fibres, or natural fibres.

11. A support plate for a floor, wall or ceiling construction for achieving decoupling between a ground and a surface lining to be affixed to the support plate, the support plate comprising:

a foil plate made of plastic foil material and provided with a plurality of chambers constituted by recesses disposed with respect to a plane of the foil plate;

wherein the foil plate further includes surface portions interdisposed between the recesses;

wherein the recesses include end portions and wall portions, the wall portions disposed between the end portions and surface portions;

wherein the wall portions extend vertically or conically between the end portions and the surface portions;

wherein first sides of the end portions form a first plate side of the foil plate, and the surface portions and inner surfaces of the recesses on an opposite side of the foil plate form a second plate side; and wherein the inner surfaces of the recesses include surfaces of the wall portions defining the recesses and also include second sides of the end portions opposite the first sides;

a woven or non-woven fabric disposed on the end portions of the recesses on the first plate side; and an adhesion-strengthening layer bonded, laminated, or welded onto inner surfaces of the recesses, and the recesses are provided for receiving a hardening contact means for forming a contact layer for receiving the surface lining;

wherein the adhesion-strengthening layer includes glass fibres, synthetic fibres, textile fibres, or natural fibres.

12. The support plate as claimed in claim 11, wherein the adhesion-strengthening layer includes at least one of a net woven fabric, a net non-woven fabric, a mesh woven fabric, a mesh non-woven fabric, a perforated woven fabric, a perforated non-woven fabric, or a synthetic foil.

13. The support plate as claimed in claim 12, wherein the adhesion-strengthening layer is the synthetic foil, the synthetic foil having at least one of inclusions or a binder, the at least one of inclusions or a binder for achieving enhanced adhesion of the adhesion-strengthening layer with the hardening contact means.

14. The support plate as claimed in claim 13, wherein the inclusions include glass fibres or granules.

* * * * *